US008333647B2

(12) United States Patent
Dimitriadis et al.

(10) Patent No.: US 8,333,647 B2
(45) Date of Patent: Dec. 18, 2012

(54) METHODS AND SYSTEMS FOR CONDUCTING A GAME

(75) Inventors: Christos Dimitriadis, Athens (GR); Vasileios Kasiotakis, Athens (GR); Chrysoula Athanasopoulou, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 0 days.

(21) Appl. No.: 13/328,220

(22) Filed: Dec. 16, 2011

(65) Prior Publication Data

US 2012/0231867 A1 Sep. 13, 2012

Related U.S. Application Data

(60) Provisional application No. 61/451,891, filed on Mar. 11, 2011.

(51) Int. Cl.
*A63F 9/24* (2006.01)

(52) U.S. Cl. ..... 463/16

(58) Field of Classification Search ..... 463/16
See application file for complete search history.

*Primary Examiner* — Omkar Deodhar
(74) *Attorney, Agent, or Firm* — Greenberg Traurig, LLP

(57) ABSTRACT

In some embodiments, the instant invention provides a computer-implemented method to conduct a drawing game that at least includes: providing a first game piece, where the first game piece has a first game data of the drawing game; receiving the first game data of the drawing game; determining a second game data of the drawing game based at least in part on: the first game data, where the second data includes the first game data, and a predetermined rule; randomly generating a third game data of the drawing game; providing a second game piece having the second game data and the third game data of the drawing game to a player, where the second game piece is capable of enabling the player to determine, by comparing the second game data and the third game data of the drawing game, whether the player wins a prize of the drawing game.

27 Claims, 11 Drawing Sheets

400

Beengo

HOW TO PLAY

Choose the preprinted card that contains the 18 numbers of your choice and deliver it for scanning to the agent to receive a ticket with your numbers in a randomly produced order. A second scan of the card will produce the winning combination of 24 numbers.

401

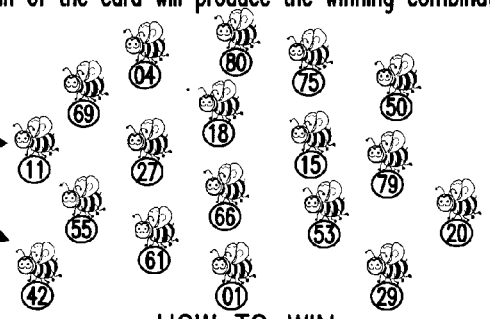

HOW TO WIN

402

Mark three or more of the numbers in the "BEEHIVE" on the first instant ticket that match any of the "YOUR BEE NUMBERS" in a straight line. You win only the highest winning prize of the game. Overall odds of winning 1 : xxx

403

| Category | Shape | | | | Winnings |
|---|---|---|---|---|---|
| I | All | Match all 18 numbers up to x drawn ones | | Bee OUT | IXXXXX |
| II | All | Match all 18 numbers | | Bee ALL | IXXXX |
| III | Outer circle | Match the 12 numbers forming the perimeter | | Bee SHELL | IXXXX |
| IV | Inner circle | Match all 6 numbers surrounding the free box in the middle | | Bee BOX | IXXXX |
| V | Snowflake | Match the inner circle and corners shapes (all 5-numbered liners) | | Bee FLAKE | IXXXX |
| VI | Popcorn | Match all 12 numbers of the shape except for the 6 corners | | Bee POP | IXXXX |
| VII | Corners | Match the 6 numbers of the corners | | Bee COR | IXXXX |
| VIII | 5-line | Match the 4 numbers of all 3 lines passing through the free box | | Bee 5 | IXXXX |
| IX | 4-line | Match the 4 numbers defining the 6 lines around the free box | | Bee 4 | IXXX |
| X | 3-line | Match the 3 numbers defining the 6 lines of the perimeter | | Bee 3 | IXX |

00975 17568 00000 00006 13372 28370 40495

FIG. 4

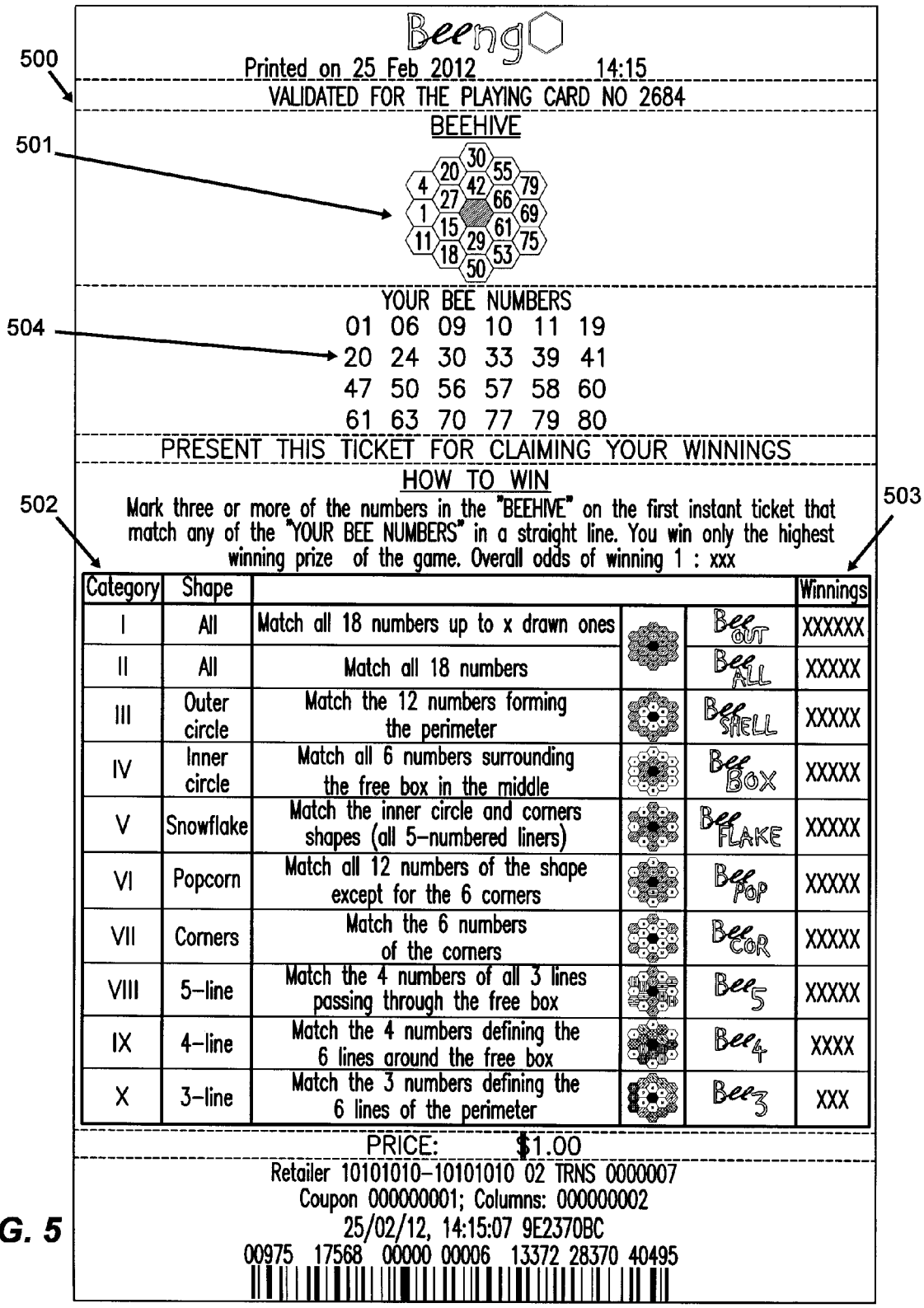

| Category | Shape | | | | Winnings |
|---|---|---|---|---|---|
| I | All | Match all 18 numbers up to x drawn ones | | BeeOUT | XXXXXX |
| II | All | Match all 18 numbers | | BeeALL | XXXXX |
| III | Outer circle | Match the 12 numbers forming the perimeter | | BeeSHELL | XXXXX |
| IV | Inner circle | Match all 6 numbers surrounding the free box in the middle | | BeeBOX | XXXXX |
| V | Snowflake | Match the inner circle and corners shapes (all 5-numbered liners) | | BeeFLAKE | XXXXX |
| VI | Popcorn | Match all 12 numbers of the shape except for the 6 corners | | BeePOP | XXXXX |
| VII | Corners | Match the 6 numbers of the corners | | BeeCOR | XXXXX |
| VIII | 5-line | Match the 4 numbers of all 3 lines passing through the free box | | Bee5 | XXXXX |
| IX | 4-line | Match the 4 numbers defining the 6 lines around the free box | | Bee4 | XXXX |
| X | 3-line | Match the 3 numbers defining the 6 lines of the perimeter | | Bee3 | XXX |

FIG. 5

700

Beengo

Printed on 25 Feb. 2012 14:15

VALIDATED FOR THE PLAYING CARD NO 2684

701

BEEHIVE

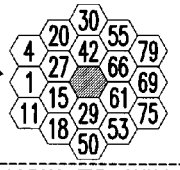

702

HOW TO WIN

Mark three or more of the numbers in the "BEEHIVE" on the first instant ticket that match any of the "YOUR BEE NUMBERS" in a straight line. You win only the highest winning prize of the game. Overall odds of winning 1 : xxx

703

| Category | Shape | | | | Winnings |
|---|---|---|---|---|---|
| I | All | Match all 18 numbers up to x drawn ones | | Bee OUT | XXXXXX |
| II | All | Match all 18 numbers | | Bee ALL | XXXXX |
| III | Outer circle | Match the 12 numbers forming the perimeter | | Bee SHELL | XXXXX |
| IV | Inner circle | Match all 6 numbers surrounding the free box in the middle | | Bee BOX | XXXXX |
| V | Snowflake | Match the inner circle and corners shapes (all 5-numbered liners) | | Bee FLAKE | XXXXX |
| VI | Popcorn | Match all 12 numbers of the shape except for the 6 corners | | Bee POP | XXXXX |
| VII | Corners | Match the 6 numbers of the corners | | Bee COR | XXXXX |
| VIII | 5-line | Match the 4 numbers of all 3 lines passing through the free box | | Bee 5 | XXXXX |
| IX | 4-line | Match the 4 numbers defining the 6 lines around the free box | | Bee 4 | XXXX |
| X | 3-line | Match the 3 numbers defining the 6 lines of the perimeter | | Bee 3 | XXX |

PRICE: $1.00

Retailer 10101010-10101010 02 TRNS 0000007
Coupon 000000001; Columns: 000000002
25/02/12, 14:15:07 9E2370BC

FIG. 7

800

801

Beengo

Printed on 25 Feb 2012 14:15

VALIDATED FOR THE PLAYING CARD
NO 2684

YOUR BEE NUMBERS 01 06 09 10 11 19
20 24 30 33 39 41
47 50 56 57 58 60
61 63 70 77 79 80

PRESENT THIS TICKET FOR YOUR CLAIMING WINNINGS

PRICE: $1.00

Retailer 10101010-10101010 02 TRNS 0000007
Coupon 000000001; Columns: 000000002
25/02/12, 14:15:07 9E2370BC 00975 17568 00000 00006 13372 28370 40495

FIG. 8

METHODS AND SYSTEMS FOR CONDUCTING A GAME

RELATED APPLICATIONS

This application claims the benefit of U.S. Provisional Application No. 61/451,891, entitled "METHODS AND SYSTEMS FOR CONDUCTING A GAME," filed Mar. 11, 2011, which is hereby incorporated by reference herein in its entirety for all purposes.

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

TECHNICAL FIELD

The instant invention relates to methods and systems for conducting a lottery-type game based at least in part on comparing a plurality of game pieces.

BACKGROUND

Typically, a lottery is a scheme for the distribution of prizes by chance. One example of a lottery is conducted by a random drawing of six numbers out of numbers from one through forty five and an entry that have all six drawn numbers selected wins a jackpot. In one example, lottery entries can be in a form of pre-printed tickets that participants buy. In another example, entries can be automatically generated at the time of the payment for an entry.

SUMMARY OF INVENTION

In some embodiments, the instant invention can provide a computer-operated method to conduct a drawing game that at least includes steps of: providing at least one first game piece, where the at least one first game piece has a first game data of the drawing game; receiving, by a computer system, the first game data of the drawing game; determining, by the computer system, a second game data of the drawing game based at least in part on: i) the first game data, where the second data at least includes the first game data, and ii) at least one predetermined rule; randomly generating, by the computer system, a third game data of the drawing game; providing, by the computer system, a second game piece having the second game data and the third game data of the drawing game to a player, where the second game piece is capable of enabling the player to determine, by comparing the second game data and the third game data of the drawing game, whether the player has won at least one prize of the drawing game.

In some embodiments, the providing, by the computer system, the first game piece at least includes displaying on a computer screen, by the computer system, the first game piece. In some embodiments, the providing, by the computer system, the first game piece at least includes outputting, by the computer system, the first game piece in a paper format. In some embodiments, the providing, by the computer system, the second game piece at least includes displaying on a computer screen, by the computer system, the second game piece. In some embodiments, the providing, by the computer system, the second game piece at least includes outputting, by the computer system, the second game piece in a paper format.

In some embodiments, the at least one predetermined rule defines a distribution of the first game data within at least one visual pattern.

In some embodiments, the receiving, by the computer system, the first game data of the drawing game occurs after or with a payment for playing the drawing game is received from the player.

In some embodiments, the instant invention can provide a computer-operated method to conduct a drawing game that at least includes steps of: providing at least one first game piece, where the at least one first game piece has a first game data of the drawing game and at least one first code that uniquely identifies the at least one first game piece; receiving, by a computer system, the at least one first code of the at least one first game piece of the drawing game; activating, by the computer system, the at least one first game piece of the drawing game based at least in part on the at least one first code; determining, by the computer system, a second game data of the drawing game, where the second game data of the drawing game is not based on the first game data of the drawing game; and providing, by the computer system, a second game piece having the second game data of the drawing game to a player, where the second game piece is capable of enabling the player to determine, by comparing the first game data and the second game data of the drawing game, whether the player has won at least one prize of the drawing game.

In some embodiments, the determining, by the computer system, the second game data of the drawing game at least includes randomly generating the second game data. In some embodiments, the determining, by the computer system, the second game data of the drawing game at least includes determining the second game data based at least in part on at least one predetermined rule. In some embodiments, the at least one predetermined rule defines a distribution of the second or the third game data within at least one visual pattern. In some embodiments, the providing the at least one first game piece of the drawing game occurs after a payment for playing the drawing game is received from the player.

In some embodiments, the instant invention can provide a computer-operated method to conduct a drawing game that at least includes steps of: providing at least one first game piece, where the at least one first game piece has a first game data of the drawing game and at least one first code that uniquely identifies the at least one first game piece; receiving, by a computer system, the first game data of the drawing game and the at least one first code of the at least one first game piece; activating, by the computer system, the at least one first game piece of the drawing game based at least in part on the at least one first code; determining, by the computer system, a second game data of the drawing game; providing, by the computer system, a second game piece having the second game data of the drawing game to a player and at least one second code associated with the at least one second game piece; receiving, by the computer system, the second game data of the drawing game and the at least one second code of the at least one second game piece; activating, by the computer system, the at least one second game piece of the drawing game based at least in part on the at least one second code; determining, by the computer system, a third game data of the drawing game; providing, by the computer system, a third game piece having the third game data of the drawing game to a player; where a combination of the at least one first game piece, the second game piece and the third game piece is capable of enabling the player to determine, by comparing the first game data, the second game data and the third game data of the drawing game, whether the player has won at least one prize of the drawing game.

In some embodiments, the providing the first game piece, the providing the second game piece, and the providing the third game piece at least include displaying on a computer screen the first game piece, the second game piece and the third game piece, respectively. In some embodiments, the providing the first game piece, the providing the second game piece, and the providing the third game piece at least includes outputting, by the computer system, the first game piece, the second game piece, and the third game piece in a paper format, respectively.

In some embodiments, the determining the second game data and the determining the third game data at least include randomly generating the second game data and the third game data, respectively. In some embodiments, the determining the second game data or the determining the third game data at least includes randomly generating the second game data or the third game data, respectively.

In some embodiments, the providing the second game piece of the drawing game occurs after a payment for playing the drawing game is received from the player. In some embodiments, the providing the third game piece of the drawing game occurs after a payment for playing the drawing game is received from the player.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

FIG. 4 shows an example of a first game piece of a first exemplary game conducted in accordance with one embodiment of the instant invention.

FIG. 5 shows an example of a second game piece of the first exemplary game that uses the first game piece of FIG. 4.

FIG. 7 shows an example of a first game piece of a second exemplary game conducted in accordance with another embodiment of the instant invention.

FIG. 8 shows an example of a second game piece of the second exemplary game that uses the first game piece of FIG. 7.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Illustrative Operating Environments

Figure 1:
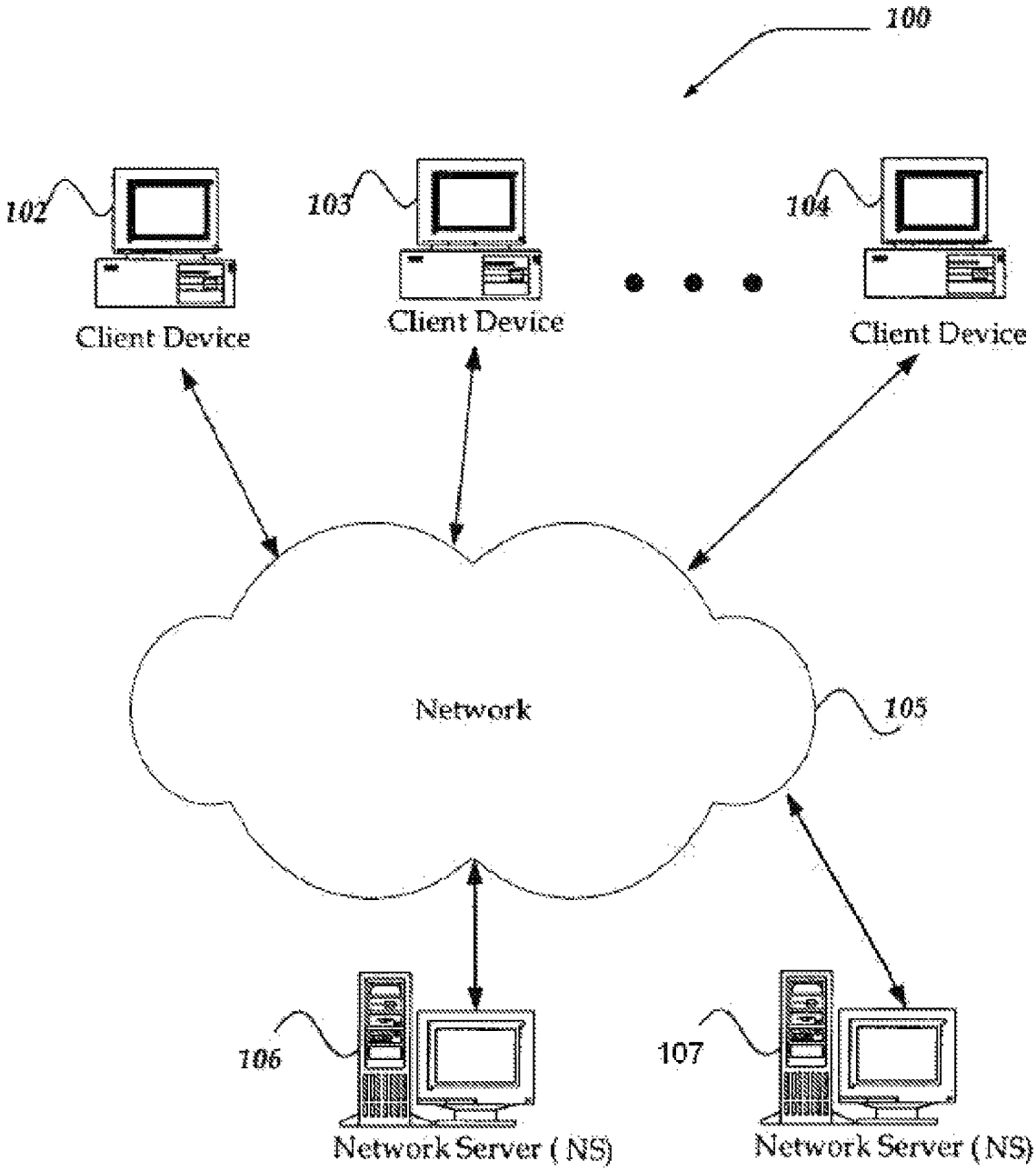
FIG. 1 shows a computer architecture supporting some embodiments of the instant invention.

FIG. 1 illustrates one embodiment of an environment in which the present invention may operate. However, not all of these components may be required to practice the invention, and variations in the arrangement and type of the components may be made without departing from the spirit or scope of the invention. In some embodiment, the inventive system for conducting a game hosts a large number of members and concurrent transactions. In other embodiments, the inventive system for conducting a game is based on a scalable computer and network architecture that incorporates varies strategies for assessing the data, caching, searching, and database connection pooling. An example of the scalable architecture is an architecture that is capable of operating multiple servers.

In embodiments, members of the inventive computer system 102-104 (e.g. user (e.g. players, agents, etc.) include virtually any computing device capable of receiving and sending a message over a network, such as network 105, to and from another computing device, such as servers 106 and 107, each other, and the like. In embodiments, the set of such devices includes devices that typically connect using a wired communications medium such as personal computers, multiprocessor systems, microprocessor-based or programmable consumer electronics, network PCs, and the like. In embodiments, the set of such devices also includes devices that typically connect using a wireless communications medium such as cell phones, smart phones, pagers, walkie talkies, radio frequency (RF) devices, infrared (IR) devices, CBs, integrated devices combining one or more of the preceding devices, or virtually any mobile device, and the like. Similarly, in embodiments, client devices 102-104 are any device that is capable of connecting using a wired or wireless communication medium such as a PDA, POCKET PC, wearable computer, and any other device that is equipped to communicate over a wired and/or wireless communication medium.

In embodiments, each member device within member devices 102-104 may include a browser application that is configured to receive and to send web pages, and the like. In embodiments, the browser application may be configured to receive and display graphics, text, multimedia, and the like, employing virtually any web based language, including, but not limited to Standard Generalized Markup Language (SMGL), such as HyperText Markup Language (HTML), a wireless application protocol (WAP), a Handheld Device Markup Language (HDML), such as Wireless Markup Language (WML), WMLScript, JavaScript, and the like. In embodiments, the invention is programmed in either Java or .Net.

In embodiments, member devices 102-104 may be further configured to receive a message from the another computing device employing another mechanism, including, but not limited to email, Short Message Service (SMS), Multimedia Message Service (MMS), instant messaging (IM), interne relay chat (IRC), mIRC, Jabber, and the like.

In embodiments, network 105 may be configured to couple one computing device to another computing device to enable them to communicate. In embodiments, network 105 may be enabled to employ any form of computer readable media for communicating information from one electronic device to another. Also, in embodiments, network 105 may include a wireless interface, and/or a wired interface, such as the Internet, in addition to local area networks (LANs), wide area networks (WANs), direct connections, such as through a universal serial bus (USB) port, other forms of computer-readable media, or any combination thereof. In embodiments, on an interconnected set of LANs, including those based on differing architectures and protocols, a router may act as a link between LANs, enabling messages to be sent from one to another.

Also, in some embodiments, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, in some embodiments, remote computers and other related electronic devices could be remotely connected to either LANs or WANs via a modem and temporary telephone link. In essence, in some embodiments, network 105 includes any communication method by which information may travel between client devices 102-104, and servers 106 and 107.

Figure 2:
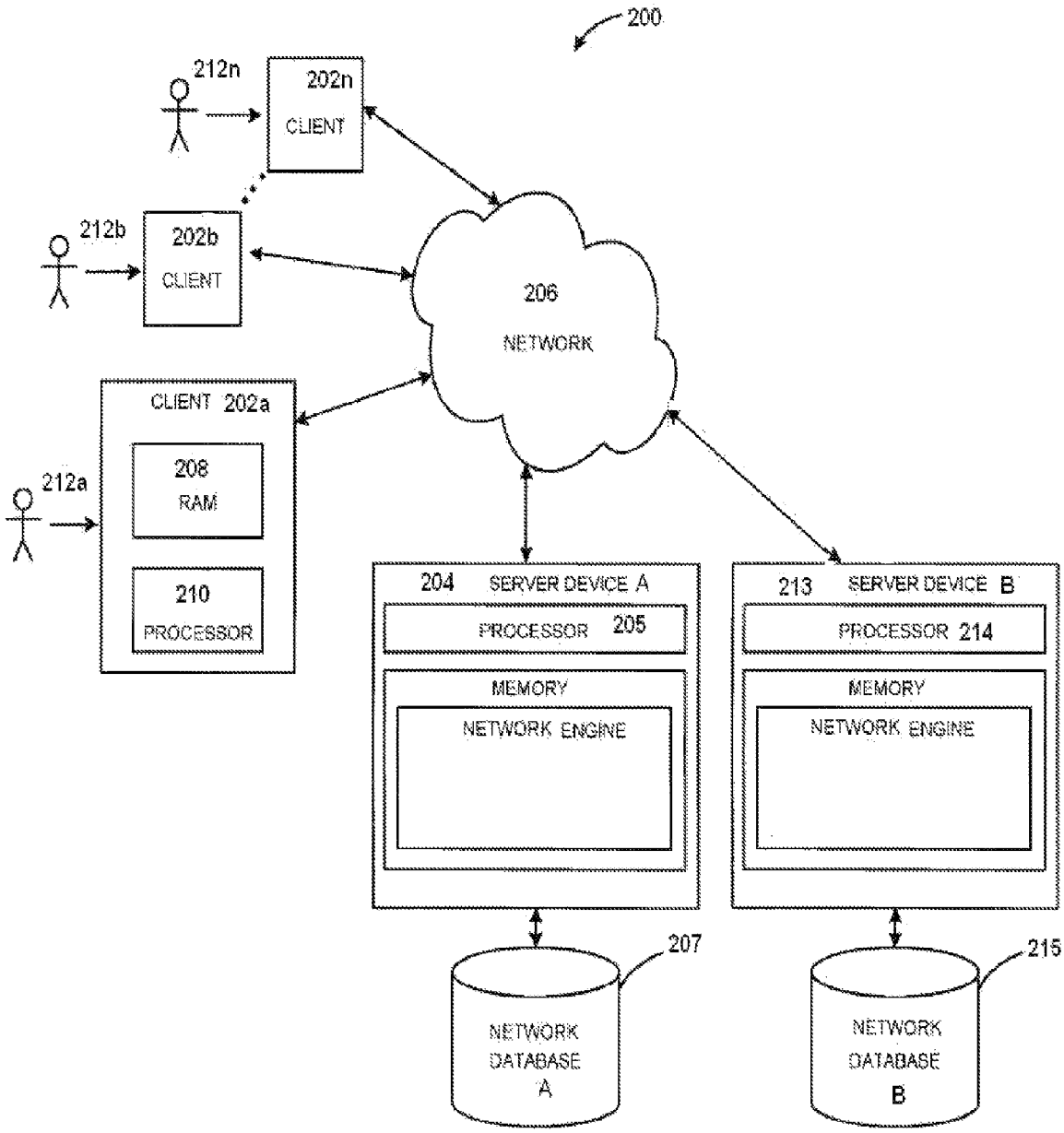
FIG. 2 shows yet another computer architecture supporting some embodiments of the instant invention.

FIG. 2 shows another exemplary embodiment of the computer and network architecture that supports the inventive system for conducting a game. The member devices 202*a*, 202*b* thru 202*n* shown (e.g., lottery terminals, players' personal electronic devices) each at least includes a computer-readable medium, such as a random access memory (RAM) 208 coupled to a processor 210 or FLASH memory. The processor 210 may execute computer-executable program instructions stored in memory 208. Such processors comprise a microprocessor, an ASIC, and state machines. Such processors comprise, or may be in communication with, media, for example computer-readable media, which stores instructions that, when executed by the processor, cause the processor to perform the steps described herein. Embodiments of computer-readable media may include, but are not limited to, an electronic, optical, magnetic, or other storage or transmission device capable of providing a processor, such as the processor 210 of client 202*a*, with computer-readable instructions. Other examples of suitable media may include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. The instructions may comprise code from any computer-programming language, including, for example, C, C++, C#, Visual Basic, Java, Python, Perl, and JavaScript.

Member devices 202*a-n* may also comprise a number of external or internal devices such as a mouse, a CD-ROM, DVD, a keyboard, a display, or other input or output devices. Examples of client devices 202*a-n* may be personal computers, digital assistants, personal digital assistants, cellular phones, mobile phones, smart phones, pagers, digital tablets, laptop computers, Internet appliances, and other processor-based devices. In general, a client device 202*a* are be any type of processor-based platform that is connected to a network 206 and that interacts with one or more application programs. Client devices 202*a-n* may operate on any operating system capable of supporting a browser or browser-enabled application, such as Microsoft™, Windows™, or Linux. The client devices 202*a-n* shown may include, for example, personal computers executing a browser application program such as Microsoft Corporation's Internet Explorer™, Apple Computer, Inc.'s Safari™, Mozilla Firefox, and Opera. Through the client devices 202*a-n*, users (e.g. players, agents, etc.) 212*a-n* communicate over the network 206 with each other and with other systems and devices coupled to the network 206. As shown in FIG. 2, server devices 204 and 213 may be also coupled to the network 206.

Illustrative Examples for Conducting Games

For purposes of these examples, the term "game piece" means either physical form (e.g., a ticket, etc.) or electronic presentation which arc representative of at least some data required for participation in a game. In some embodiments, all game pieces are rendered in physical form. In some embodiments, all game pieces are rendered in electronic representation form. In some embodiments, at least one game piece of the game is in physical form and at least one game piece of the game is in electronic representation form.

For purposes of these examples, the term "indicia" means visible and/or invisible representations of game data on a game piece. In some embodiments, the term "indicia" can be, for example, but is not limited to, number(s), character(s), geometrical shapes, playing cards, dice, game boards, and/or combination(s) thereof.

For purposes of these examples, the term "game holding authority" includes action(s)/activity(ies) performed by a computer system.

In some embodiments, the instant invention can provide a computer-operated method to conduct a drawing game that at least includes steps of: providing at least one first game piece, where the at least one first game piece has a first game data of the drawing game; receiving, by a computer system, the first game data of the drawing game; determining, by the computer system, a second game data of the drawing game based at least in part on: i) the first game data, where the second data at least includes the first game data, and ii) at least one predetermined rule; randomly generating, by the computer system, a third game data of the drawing game; providing, by the computer system, a second game piece having the second game data and the third game data of the drawing game to a player, where the second game piece is capable of enabling the player to determine, by comparing the second game data and the third game data of the drawing game, whether the player has won at least one prize of the drawing game.

In some embodiments, the providing, by the computer system, the first game piece at least includes displaying on a computer screen, by the computer system, the first game piece. In some embodiments, the providing, by the computer system, the first game piece at least includes outputting, by the computer system, the first game piece in a paper format. In some embodiments, the providing, by the computer system, the second game piece at least includes displaying on a computer screen, by the computer system, the second game piece. In some embodiments, the providing, by the computer system, the second game piece at least includes outputting, by the computer system, the second game piece in a paper format.

In some embodiments, the at least one predetermined rule defines a distribution of the first game data within at least one visual pattern.

In some embodiments, the receiving, by the computer system, the first game data of the drawing game occurs after or with a payment for playing the drawing game is received from the player.

In some embodiments, the instant invention can provide a computer-operated method to conduct a drawing game that at least includes steps of: providing at least one first game piece, where the at least one first game piece has a first game data of the drawing game and at least one first code that uniquely identifies the at least one first game piece; receiving, by a computer system, the at least one first code of the at least one first game piece of the drawing game; activating, by the computer system, the at least one first game piece of the drawing game based at least in part on the at least one first code; determining, by the computer system, a second game data of the drawing game, where the second game data of the drawing game is not based on the first game data of the drawing game; and providing, by the computer system, a second game piece having the second game data of the drawing game to a player, where the second game piece is capable of enabling the player to determine, by comparing the first game data and the second game data of the drawing game, whether the player has won at least one prize of the drawing game.

In some embodiments, the determining, by the computer system, the second game data of the drawing game at least includes randomly generating the second game data. In some embodiments, the determining, by the computer system, the second game data of the drawing game at least includes determining the second game data based at least in part on at least one predetermined rule. In some embodiments, the at least one predetermined rule defines a distribution of the second or the third game data within at least one visual pattern. In some embodiments, the providing the at least one first game piece of the drawing game occurs after a payment for playing the drawing game is received from the player.

In some embodiments, the instant invention can provide a computer-operated method to conduct a drawing game that at least includes steps of: providing at least one first game piece, where the at least one first game piece has a first game data of the drawing game and at least one first code that uniquely identifies the at least one first game piece; receiving, by a computer system, the first game data of the drawing game and the at least one first code of the at least one first game piece; activating, by the computer system, the at least one first game piece of the drawing game based at least in part on the at least one first code; determining, by the computer system, a second game data of the drawing game; providing, by the computer system, a second game piece having the second game data of the drawing game to a player and at least one second code associated with the at least one second game piece; receiving, by the computer system, the second game data of the drawing game and the at least one second code of the at least one second game piece; activating, by the computer system, the at least one second game piece of the drawing game based at least in part on the at least one second code; determining, by the computer system, a third game data of the drawing game; providing, by the computer system, a third game piece having the third game data of the drawing game to a player; where a combination of the at least one first game piece, the second game piece and the third game piece is capable of enabling the player to determine, by comparing the first game data, the second game data and the third game data of the drawing game, whether the player has won at least one prize of the drawing game.

In some embodiments, the providing the first game piece, the providing the second game piece, and the providing the third game piece at least include displaying on a computer screen the first game piece, the second game piece and the third game piece, respectively. In some embodiments, the providing the first game piece, the providing the second game piece, and the providing the third game piece at least includes outputting, by the computer system, the first game piece, the second game piece, and the third game piece in a paper format, respectively.

In some embodiments, the determining the second game data and the determining the third game data at least include randomly generating the second game data and the third game data, respectively. In some embodiments, the determining the second game data or the determining the third game data at least includes randomly generating the second game data or the third game data, respectively.

In some embodiments, the providing the second game piece of the drawing game occurs after a payment for playing the drawing game is received from the player. In some embodiments, the providing the third game piece of the drawing game occurs after a payment for playing the drawing game is received from the player.

Examples for Conducting Type 1 Games

Figure 3:
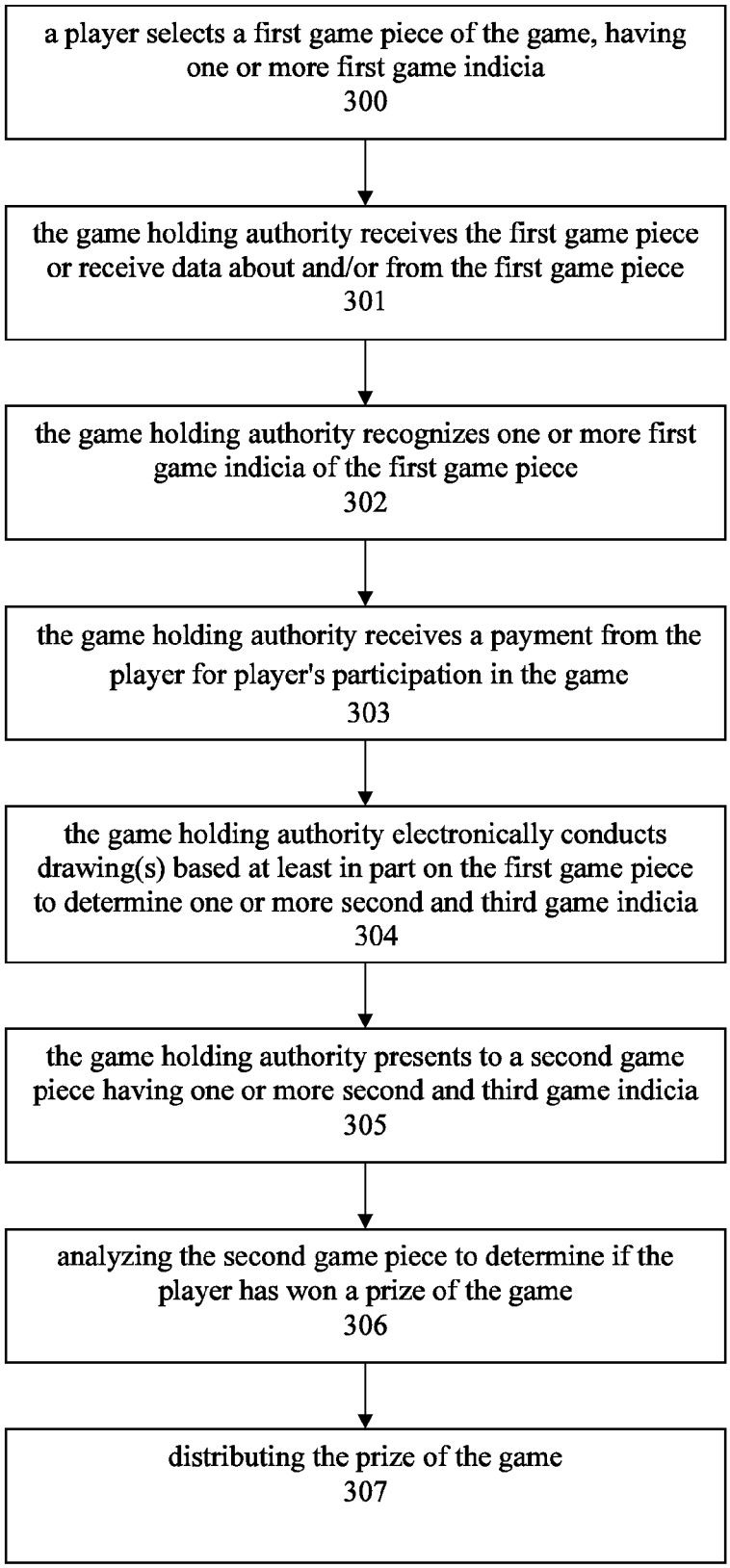
FIG. 3 shows an operational flow chart for performing some embodiments of the instant invention.

In some embodiments, the type 1 games are based at least in part on having at least two game pieces. Referring to FIG. 3. In some embodiments, in the initial step, block 300, a player obtains/selects a first game piece containing a first game data. In some embodiments, the first game piece can be selected from pre-printed illustrative game pieces. In some embodiments, the first game data can include one or more first game indicia. In some embodiments, the one or more first game indicia of the first game data can be, for example, but is not limited to, number(s), character(s), geometrical shapes, playing cards, dice, game boards, and/or combination(s) thereof. In some embodiments, the one or more first game indicia of the first game data can be unique. In some embodiments, the one or more first game indicia of the first game data, the player can add one or more personal indicia (e.g., write in additional numbers, characters, shapes, etc.) to the first game data of the first game piece. In some embodiments, the game rule(s) requires the player to select at least one subset (not all) of first game indicia (e.g., select one or more numbers, characters, shapes, etc.) from the first game data of the first game piece and the selected at least one subset of first game indicia is then received by the game holding authority for playing the game by the player.

In some embodiments, the one or more first game indicia of the first game data is based at least in part on the game data depicted on the first game piece. In some embodiments, the one or more first game indicia of the first game data can be encoded in a code of a machine-readable format (e.g., barcode, Semacode, Sms barcode, SPARQCode, etc.)

In some embodiments, the first game piece can have also first identification data, which is separate from the game data and used to uniquely identify an instance of the game played. In some embodiments, the first identification data can be, but is not limited to, in a form of a code of the machine-readable format (e.g., barcode, Semacode, Sms barcode, SPARQCode, etc.).

In some embodiments, the first game piece can be generated by and/or shown at a lottery terminal. In some embodiments, the first game piece is electronic data/representation indicative of the game data (e.g., graphical representation of the first part of the game on a monitor, etc.)

In some embodiments, in the next step, block 301, the game holding authority receives the first game piece or information about the first game piece that the player presents/submits to the game holding authority or its distributor. In some embodiment, if the first game piece is in its physical form (e.g., ticket), the player presents/submits the first game piece to the game holding authority by submitting the first game piece into an electronic vending machine (e.g., lottery terminal) or handing it to a representative of the game holding authority (e.g., an operator of lottery terminal). In some embodiment, if the first game piece is in its electronic representation form, the player selects/submits the first game piece by electronically communicating his or her selection by a computing device (e.g., computer, PDA, phone, etc).

In some embodiments, in the next step, block 302, the game holding authority recognizes the one or more first game indicia of first game piece submitted by the player (e.g., scanning the first game piece for the one or more first game indicia) and/or recognizes the machine-readable code (e.g., barcode) associated with the first game piece. In some embodiments, in the next step, block 303, the player pays for its participation in the game (i.e., buys one or more chances). In some embodiments, if the game holding authority operates the game through a network of game distributor(s) (e.g., human-assisted and/or unassisted lottery vending terminal(s)), the game holding authority electronically receives, by its centralized server/host, data about the first game piece from its distributor(s). In some embodiments, the game holding authority activates the first game piece by verifying the first game piece, the payment information and/or both. In some embodiments, the game holding authority verifies the code (e.g., barcode) associated with the first game piece. For example, in some embodiments, the game holding authority verifies whether the first game piece was played before. In some embodiments, the game holding authority logs the player's entry (e.g., the first game piece data, payment, etc.) upon the verification.

In some embodiments, in the next step, block 304, the game holding authority electronically determines an outcome from an instant/on-the-spot draw (i.e., no predetermined outcome(s) prior to the player's submission of the first game piece) for the first game piece submitted by the player. In some embodiments, in this step, block 304, the game holding authority electronically conducts at least two drawings, Drawing 1 and Drawing 2. In some embodiments, Drawing 1 determines the at least one or more second game indicia of second game data based at least in part on utilizing the one or more first game indicia of the first game data in accordance with at least one predetermined rule. In some embodiments, the at least one predetermined rule define one or more visual arrangements of the one or more first game indicia to generate the one or more second game indicia of the second game data for the second game piece. In some embodiments, the at least one predetermined rule define how the one of more first game indicia of the first game data can be randomly manipulated to generate the one or more second game indicia of the second game data.

For example, in some embodiments, if the one of more first game indicia of the first game data are numbers, the at least one predetermined rule defines how these numbers are manipulated to produce the one or more second game indicia of the second game data (e.g., using mathematical calculation(s) on the numbers from the first game data to generated new number(s) of the second game data) and how to present the second game data on the second game piece. In another example, the at least one predetermined rule defines a random order in which numbers of the first indicia are presented in the second game data.

In some embodiments, Drawing 2 determines one or more third game indicia for the third game data of the game to be presented on the second game piece. In some embodiments, the one or more third game indicia are unique indicia. In some embodiments, one or more third game indicia of the third game data can be, for example, but is not limited to, number(s), character(s), geometrical shapes, playing cards, dice, game boards, and/or combination(s) thereof. In some embodiments, the one or more third game indicia is randomly generated/selected. In some embodiments, the one or more third game indicia is not generated based at least in part on the one or more first game indicia. In some embodiments, the one or more third game indicia is generated based at least in part on the one or more first game indicia, the one or more second game indicia, or both.

In some embodiments, after the game holding authority electronically determines the outcome of the game for the first game piece submitted by the player, in the next step, block 305, the game holding authority presents the second game piece to the player (e.g., a second ticket, on-screen second presentation, etc). In some embodiments, if the game holding authority operates the game through a network of its game distributor(s), after the game holding authority electronically determines the outcome by its centralized server/host, the game holding authority transmits data of the second game piece (i.e., the outcome of the drawing(s)) to its distributor (e.g., lottery terminal) to which the player submitted the first game piece and the distributor presents the second game piece to the player (e.g., printout of a second ticket, on-screen presentation, etc).

In some embodiments, the second game piece includes the first game data from the first game piece and the new game data generated based on the drawing(s) by the game holding authority after the player submits the first game piece. In some embodiments, the second game piece includes only data representative of the outcome of the drawing(s) by the game holding authority. In some embodiments, if the game holding authority operates the game through a network of its lottery terminals, the relevant lottery terminal can also record the game holding authority's approval of the purchase of the game by the player (i.e., approval of the player's credit card information, etc.)

In some embodiments, the first game piece can have also first identification data, which is separate from the game data and used to uniquely identify an instance of the game played. In some embodiments, the first identification data can be, but is not limited to, in a form of a code of the machine-readable format (e.g., barcode, Semacode, Sms barcode, SPARQCode, etc.). In some embodiments, the first identification data can be provided on the second game piece to uniquely identify the second game piece as belonging to the same instance of the game played as the first game piece. In some embodiments, the second game piece can have its own second identification data which can have, for example, a different code of the machine-readable format (e.g., barcode, Semacode, Sms barcode, SPARQCode, etc.); however, an association between the first identification data and the second identification data is maintained to uniquely identify that both, the first identification data and the second identification data, are related to the same played instance of the game.

In some embodiments, in the next step, block 306, the player can review the second game piece to determine, by analyzing the second and third game data (i.e., the one or more second and third indicia) if the player has won at least one prize of the game. In some embodiments, the player submits the second game piece to the game holding authority (e.g., submitting to lottery terminal or the operator of the lottery terminal) which determines, by analyzing the second and third game data of the game (i.e., the one or more second and third indicia), if the player has won at least one prize of the game. In some embodiments, if the game holding authority operates the game through a network of game distributor(s) (e.g., human-assisted and/or unassisted lottery vending terminal(s)), the game holding authority electronically receives data about the second game piece from its distributor(s) by its centralized server/host and determines, by analyzing the second and third game data of the game (i.e., the one or more second and third indicia), if the player has won at least one prize of the game. In some embodiments, the game holding authority can also verify the first and/or second game pieces prior to analyzing them.

In some embodiments, the player can review the first and the second game pieces to determine, by analyzing the first, second and third game data (i.e., the one or more first, second and third indicia) if the player has won at least one prize of the game. In some embodiments, the player submits the first and the second game pieces to the game holding authority (e.g., submitting to lottery terminal or the operator of the lottery terminal) which determines, by analyzing the first, second and third game data of the game (i.e., the one or more first, second and third indicia), if the player has won at least one prize of the game. In some embodiments, if the game holding authority operates the game through a network of game distributor(s) (e.g., human-assisted and/or unassisted lottery vending terminal(s)), the game holding authority electronically receives data about the first and second game pieces from its distributor(s) by its centralized server/host and determines, by analyzing the first, second and third game data of the game (i.e., the one or more first, second and third indicia), if the player has won at least one prize of the game. In some embodiments, the game holding authority can also verify the first and/or second game pieces prior to analyzing them.

In some embodiments, in the next step, block 307, if the game holding authority and/or its representative determine that the player has won at least one prize of the game, the won prize is distributed to the player. In some embodiments, if the game holding authority operates the game through a network of game distributor(s) (e.g., human-assisted and/or unassisted lottery vending terminal(s)), the game holding authority electronically transmits, by its centralized server/host, its approval to distribute the won prize to its distributor that transacts with the player.

Referring to FIG. 4. FIG. 4 shows an example of the first game piece (400) of an exemplary game so-called "Beengoo," conducted in accordance with the Type 1 games of the instant invention. In some embodiments, the first game piece (400) provides a set of first game indicia (401) representing the first game data (random numbers) of the exemplary game "Beengo." In some embodiments, the first game piece (400) can also provide rule(s) (402) of the game and prize payout information (403).

Referring to FIG. 5. FIG. 5 shows an example of the second game piece (500) of the exemplary game so-called "Beengo," conducted in accordance with the Type 1 games of the instant invention. In some embodiments, the second game piece (500) provides a set of second game indicia (501) in a shape of a beehive in which each cell has a number selected from the first game data (401) based at least in part on at least one predetermine rule. In some embodiments, each number in the second game indicia (501) is randomly assigned, based on Drawing 1, to its respective cell of the beehive. In some embodiments, each number in the second game indicia (501) is assigned to its respective cell of the beehive based in part on the number's position on the first game piece (400). In some embodiments, the second game piece (500) also provides a set of third game indicia (504), which are randomly generated numbers by the Drawing 2. In some embodiments, the second game piece (500) can also provide rule(s) (502) of the game and prize payout information (503). In some embodiments, the player or lottery terminal analyzes the second game indicia (501) and the third game indicia (504) to determine if the player has won at least one prize of the game based on the rule(s) (502) and the prize payout information (503).

Examples for Conducting Type 2 Games

Figure 6:
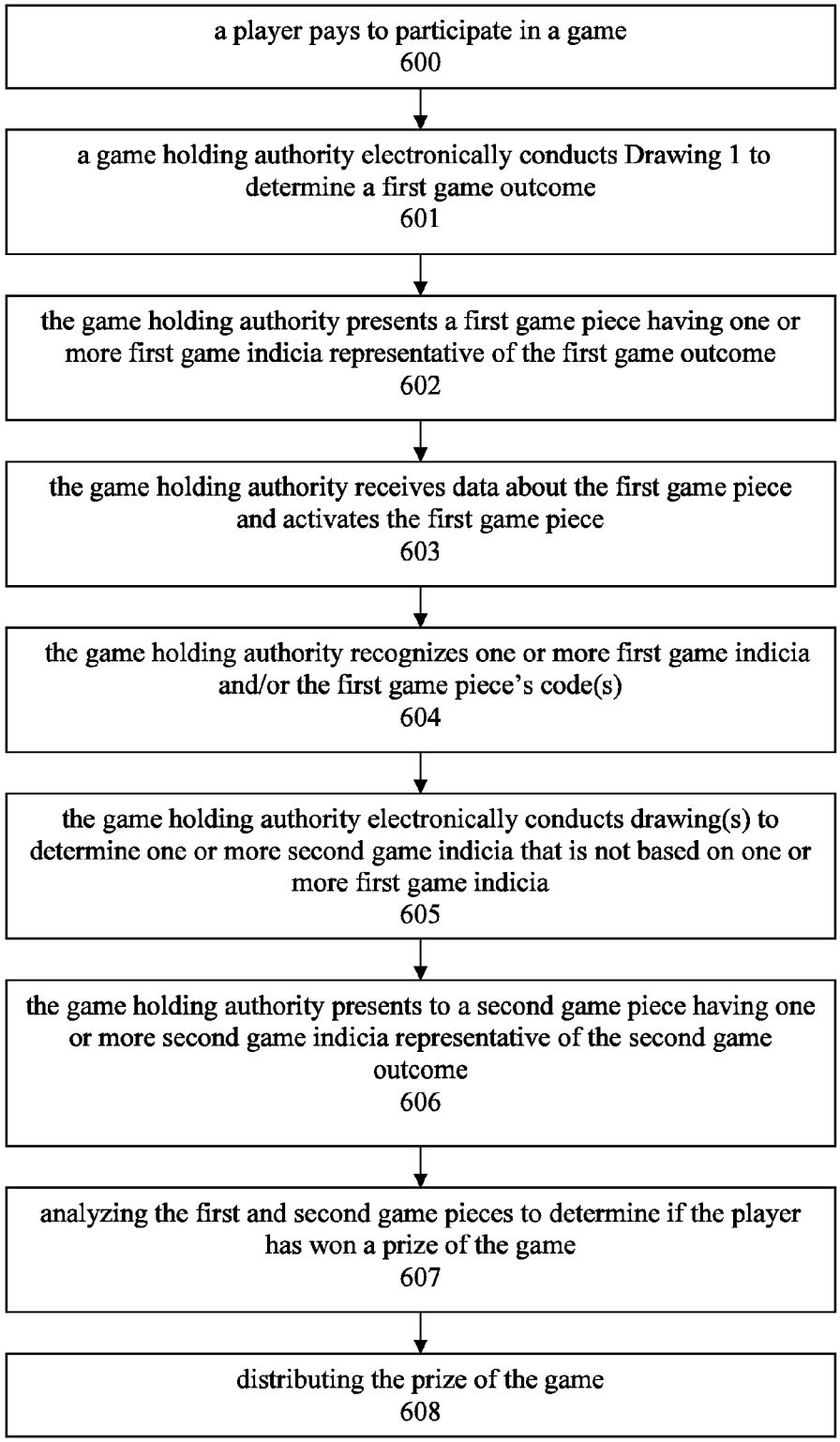
FIG. 6 shows another operational flow chart for performing some embodiments of the instant invention.

In some embodiments, the type 2 games are based at least in part on having at least two game pieces. Referring to FIG. 6. In some embodiments, in the initial step, block 600, a player pays for its participation in a game (i.e., buys one or more chances). In some embodiments, if the game holding authority operates the game through a network of game distributor(s) (e.g., human-assisted and/or unassisted lottery vending terminal(s)), the game holding authority electronically receives, by its centralized server/host, player's purchase data about the player's purchase from a distributor that transacts the player. In some embodiments, the game holding authority verifies the player's payment and records the purchase in a log.

In some embodiments, in the next step, block 601, the game holding authority electronically conducts a Drawing 1 by determining a first game outcome from one or more predetermined game outcomes and/or from an instant/on-the-spot draw. In some embodiments, the Drawing 1 is conducted based at least in part on one or more predetermined rules to select the first game outcome from a plurality of predetermined games outcomes. In some embodiments, the Drawing 1 is conducted based at least in part on a random selection of the first game outcome from the plurality of predetermined games outcomes.

In some embodiments, after the game holding authority electronically determines the first outcome of the game, in the next step, block 602, the game holding authority presents to the player a first game piece (e.g., a first ticket, on-screen first presentation, etc) which has one or more first game indicia of first data that is indicative of the first outcome of the Drawing 1. In some embodiments, if the game holding authority operates the game through a network of its game distributor(s), after the game holding authority electronically determines, by its centralized server/host, the first outcome, the game holding authority transmits data indicative of the first outcome to its distributor (e.g., lottery terminal) that is transacting with the player. In some embodiments, the transacting lottery terminal records the approval of the purchase by the gaming holding authority. In some embodiments, the one or more first game indicia of the first game data can be unique. In some embodiments, the one or more first game indicia of the first game data is based at least in part on the game data depicted on the first game piece. In some embodiments, the one or more first game indicia of the first game data can be encoded in a code of a machine-readable format (e.g., barcode, Semacode, Sms barcode, SPARQCode, etc.)

In some embodiments, the first game piece can have also first identification data, which is separate from the game data and used to uniquely identify an instance of the game played. In some embodiments, the first identification data can be, but is not limited to, in a form of a code of the machine-readable format (e.g., barcode, Semacode, Sms barcode, SPARQCode, etc.).

In some embodiments, in the next step, block 603, the game holding authority receives and activates the first game piece. In some embodiment, if the first game piece is in its physical form (e.g., ticket), the player presents/submits the first game piece to the game holding authority receiving the first game piece by submitting the first game piece into an electronic vending machine (e.g., lottery terminal) or handing it to a representative of the game holding authority (e.g., an operator of lottery terminal). In some embodiments, the game holding authority receives data about and/or from the first game piece. In some embodiment, if the first game piece is in its electronic representation form, the game holding authority receives from the player the selected/submitted first game piece by electronically receiving the player's selection from a computing device the player or another entity who conducts the game on behalf of the game holding authority (e.g., computer, PDA, phone, etc). In some embodiments, the one or more first game indicia of the first game data, the player can add one or more personal indicia (e.g., write in additional numbers, characters, shapes, etc) to the first game data of the first game piece. In some embodiments, the game rule(s) requires the player to select at least one subset (not all) of first game indicia (e.g., select one or more numbers, characters, shapes, etc) from the first game data of the first game piece and the selected at least one subset of first game indicia is then received by the game holding authority for playing the game by the player. In some embodiments, the game holding authority activates the first game piece by validating one or more codes associated with the first game pieces that the game holding authority receives.

In some embodiment, in the next step, block 604, the game holding authority recognizes the one or more first game indicia of first game piece submitted by the player (e.g., scanning the first game piece for the one or more first game indicia) and/or recognizes the machine-readable code (e.g., barcode) associated with the first game piece. In some embodiments, if the game holding authority operates the game through a network of game distributor(s) (e.g., human-assisted and/or unassisted lottery vending terminal(s)), the game holding authority electronically receives, by its centralized server/host, data about the first game piece from its distributor(s). In some embodiments, the game holding authority verifies the first game piece's information. In some embodiments, the game holding authority check if second game data of the game is available.

In some embodiments, in the next step, block 605, the game holding authority electronically conducts a Drawing 2 by determining a second game outcome from one or more predetermined game outcomes and/or from an instant/on-the-spot draw where the one or more predetermined game outcomes and the instant/on-the-spot draw are not based on the first game data of the game. In some embodiments, the game holding authority electronically conducts the Drawing 2 by determining the second game outcome from one or more predetermined game outcomes and/or from an instant/on-the-spot draw where the one or more predetermined game outcomes and the instant/on-the-spot draw are based at least in part on the first game data (i.e., one or more first game indicia of the game) and/or code associated with the first game piece. In some embodiments, the Drawing 2 is conducted based at least in part on one or more predetermined rules to select the second game outcome from a plurality of predetermined games outcomes. In some embodiments, the Drawing 2 is conducted based at least in part on a random selection of the second game outcome from the plurality of predetermined games outcomes. In some embodiments, the game holding authority electronically associates the second game outcome with player's instance of the game (i.e., the unique code (e.g., barcode) of the first game piece).

In some embodiments, after the game holding authority electronically determines the second outcome of the game, in the next step, block 606, the game holding authority presents to the player a second game piece (e.g., a second ticket, on-screen second presentation, etc) which has one or more second game indicia of second game data that is indicative of the second outcome of the Drawing 2. In some embodiments, if the game holding authority operates the game through a network of its game distributor(s), after the game holding authority electronically determines, by its centralized server/host, the second outcome, the game holding authority transmits data indicative of the second outcome to its distributor (e.g., lottery terminal) that is transacting with the player. In some embodiments, the transacting lottery terminal records the second game data. In some embodiments, the one or more second game indicia of the second game data can be unique. In some embodiments, the one or more second game indicia of the second game data can be encoded in a second code of a machine-readable format (e.g., barcode, Semacode, Sms barcode, SPARQCode, etc.)

In some embodiments, the first identification data can be provided on the second game piece to uniquely identify the second game piece as belonging to the same instance of the game played as the first game piece. In some embodiments, the second game piece can have its own second identification data which can have, for example, a different code of the machine-readable format (e.g., barcode, Semacode, Sms barcode, SPARQCode, etc.); however, an association between the first identification data and the second identification data is maintained to uniquely identify that both, the first identification data and the second identification data, are related to the same played instance of the game.

In some embodiments, in the next step, block 607, the player can review the second game piece to determine, by analyzing the first and second game data of the first and the second game pieces of the game (i.e., the one or more first and second indicia) if the player has won at least one prize of the game. In some embodiments, the player submits the second game piece with the first game piece to the game holding authority (e.g., submitting to lottery terminal or the operator of the lottery terminal) which determines, by analyzing the first and second game data of the game (i.e., the one or more first and second indicia), if the player has won at least one prize of the game. In some embodiments, the player submits the second game piece to the game holding authority (e.g., submitting to lottery terminal or the operator of the lottery terminal) which identifies the player's first game data (electronically logged by the game holding authority) based at least in part on the second code (e.g., barcode) which is associated with the second game piece and the player's instance of the game. In some embodiments, after the game holding authority identifies the player's first game data, the game holding authority determines, by analyzing the first and second game data of the game (i.e., the one or more first and second indicia), if the player has won at least one prize of the game. In some embodiments, if the game holding authority operates the game through a network of game distributor(s) (e.g., human-assisted and/or unassisted lottery vending terminal(s)), the game holding authority electronically receives, by its centralized server/host, data about the second game piece from its distributor(s) and determines, by analyzing the first and second game data of the game (i.e., the one or more first and second indicia), if the player has won at least one prize of the game. In some embodiments, the game holding authority can also verify the second game piece prior to analyzing it to determine whether the player's instance of the game is winnable. In some embodiments, the game holding authority can update a prize table to indicate that the prize won by the player is no longer available in further for other instances of the game.

In some embodiments, in the next step, block 608, if the game holding authority and/or its representative determine that the player has won at least one prize of the game, the won prize is distributed to the player. In some embodiments, if the game holding authority operates the game through a network of game distributor(s) (e.g., human-assisted and/or unassisted lottery vending terminal(s)), the game holding authority electronically transmits, by its centralized server/host, its approval to distribute the won prize to its distributor that transacts with the player.

Referring to FIG. 7. FIG. 7 shows an example of the first game piece (700) of an exemplary game so-called "Beengo," conducted in accordance with the Type 2 games of the instant invention. In some embodiments, the first game piece (700) of the exemplary game "Beengo" provides a set of first game indicia (701) in a shape of a beehive in which each cell has a number. In some embodiments, the set of first game indicia (701) represents the first outcome of the Drawing 1. In some embodiments, as detailed above for the Type 2 games, the first game piece (700) is generated after the player purchases a chance (an instance) to play the game. In some embodiments, the first game piece (700) can also provide rule(s) (702) of the game and prize payout information (703).

Referring to FIG. 8. FIG. 8 shows an example of the second game piece (800) of the exemplary game so-called "Beengo," conducted in accordance with the Type 2 games of the instant invention. In some embodiments, the second game piece (800) provides a set of the second game indicia (801), which are randomly generated numbers by the Drawing 2. In some embodiments, the player and/or the game holding authority (e.g., lottery terminal) analyze the first (701) and the second game indicia (801) to determine if the player has won at least one prize of the game based on the rule(s) (702) and the prize payout information (703).

Examples for Conducting Type 3 Games

In some embodiments of the instant invention, the Type 3 games can be conducted based on at least three game pieces. In some embodiments, a player initially buys or pays for a 1st pre-printed game piece (e.g., ticket). For example, in some embodiments, the game can start when a player selects first game piece out of a displayed stock of pre-printed illustrative game pieces containing part of first game data and a first identifier, which can be an unique identifier.

In some embodiments of the instant invention, as the next step, the player reviews first game piece. In some embodiments of the instant invention, as the next step, the player presents first game piece to a lottery terminal or a game holding authority. In some embodiments of the instant invention, as the next step, the lottery terminal or the game holding authority reads first identifier. In some embodiments of the instant invention, as the next step, the player purchases a chance to play the game. In some embodiments of the instant invention, as the next step, the lottery terminal or the game holding authority accepts the payment. In some embodiments of the instant invention, as the next step, the lottery terminal or the game holding authority transmits player's purchase to a host.

In some embodiments of the instant invention, as the next step, the host receives the player's purchase. In some embodiments of the instant invention, as the next step, the host logs the player's purchase. In some embodiments of the instant invention, as the next step, the host may conduct security check on the player's purchase (e.g., if ticket played before.) In some embodiments of the instant invention, as the next step, the host determines outcome (e.g., from predetermined pool of outcomes or on-the-spot draw.) In some embodiments of the instant invention, as the next step, the host generates a second part of game play data. In some embodiments of the instant invention, as the next step, the host transmits an approval to the lottery terminal or the game authority.

In some embodiments of the instant invention, as the next step, the lottery terminal or the game authority dispenses the second game piece containing the second part of the game play data. In some embodiments of the instant invention, as the next step, the player reviews first and second set of game play data. In some embodiments of the instant invention, as the next step, the player presents first game piece again to the lottery terminal or the game authority.

In some embodiments of the instant invention, as the next step, the lottery terminal or the game authority reads first unique identifier again. In some embodiments of the instant invention, as the next step, the lottery terminal or the game authority transmits first unique identifier to the host again. In some embodiments of the instant invention, as the next step, the host receives the player's first unique identifier again. In some embodiments of the instant invention, as the next step, the host checks if the second part of game data has been produced. In some embodiments of the instant invention, as the next step, the host determines outcome (e.g., from predetermined pool of outcomes or on-the-spot draw.) In some embodiments of the instant invention, as the next step, the host associates second unique identifier with the chance. In some embodiments of the instant invention, as the next step, the host generates a third set of play data. In some embodiments of the instant invention, as the next step, the host transmits approval to the lottery terminal or the game authority.

In some embodiments of the instant invention, as the next step, the lottery terminal or the game authority dispenses a third game piece. In some embodiments of the instant invention, as the next step, the player tenders the third game piece to the lottery terminal or the game authority after reviewing the first and second game pieces against the game data information on the third game piece. In some embodiments of the instant invention, as the next step, the lottery terminal or the game authority receives the third game piece. In some embodiments of the instant invention, as the next step, the lottery terminal or the game authority reads the second unique identifier. In some embodiments of the instant invention, as the next step, the lottery terminal or the game authority transmits second unique identifier to the host.

In some embodiments of the instant invention, as the next step, the host receives the second unique identifier. In some embodiments of the instant invention, as the next step, the host may verify the second unique identifier. In some embodiments of the instant invention, as the next step, the host determines prize. In some embodiments of the instant invention, as the next step, the host updates prize table. In some embodiments of the instant invention, as the next step, the host transmits an approval to the lottery terminal or the game authority.

In some embodiments of the instant invention, as the next step, the lottery terminal or the game authority receives the approval to dispense a prize. In some embodiments of the instant invention, as the next step, the lottery terminal or the game authority dispenses the prize.

In some embodiments of the instant invention, the inventive game can be conducted by distributing a first game piece. In some embodiments of the instant invention, the next step is an activation of the first game piece. In some embodiments of the instant invention, the next step is a tender of a purchase price. In some embodiments of the instant invention, the next step is that a player receives a second game piece (e.g., ticket) with the rest of the game play data. In some embodiments of the instant invention, the next step is an activation of the second game piece. In some embodiments of the instant invention, the next step is that the player receives a third game piece with additional game data. In some embodiments of the instant invention, the next step is that the player compares the game play data of all three play areas on corresponding pieces (e.g., tickets) (e.g., first two against the third one). In some embodiments of the instant invention, the next step is to determine if the game piece(s) (e.g., the combination of tickets of the instance played) is a winner. In some embodiments of the instant invention, the next step is to distribute prize(s).

Figure 9:
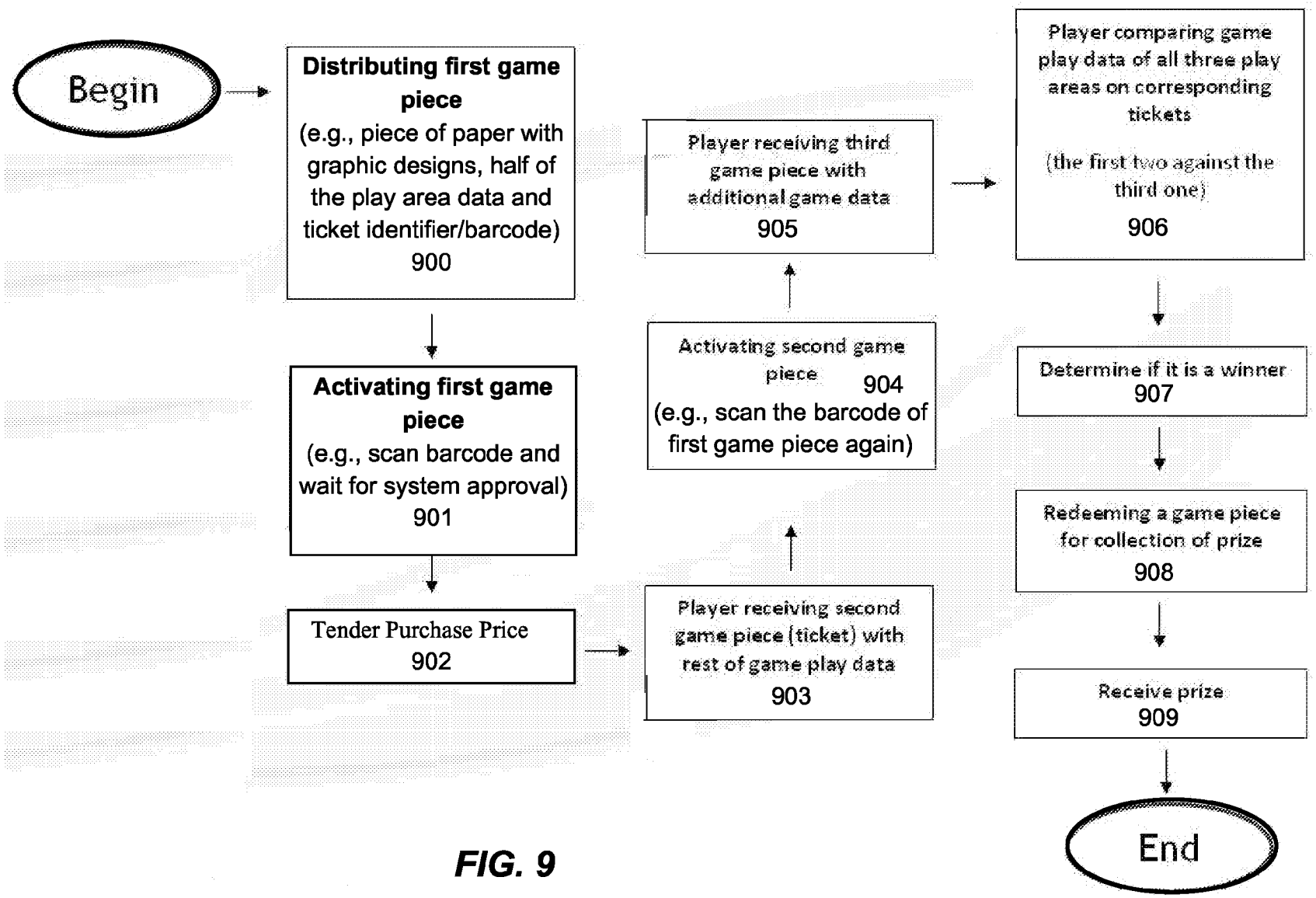
FIG. 9 shows yet another operational flow chart for performing some embodiments of the instant invention.

Referring to FIG. 9. In some embodiments, in the initial step, block 900, a first game piece is distributed. In some embodiments, the first game piece can be a ticket with first game indicia of first game data of the game (e.g., graphic designs, etc) and a ticket identifier (e.g., barcode) which can be part of the first game indicia. In some embodiments, in the next step, block 901, the first game piece is activated when the player submits the first game piece to the game holding authority or its distributor. In some embodiments, the first game piece is activated when the barcode is read. In some embodiments, the first game piece is activated when the game holding authority approves the validity of the first game piece. In some embodiments, in the next step, block 902, the player tenders a purchase price for a chance (an instance) to play the game. In some embodiments, in the next step, block 903, after the player's purchase has been approved, the game holding authority provides the player with a second game piece (e.g., a second ticket) carrying one or more second indicia of second game data of the game. In some embodiments, in the next step, block 904, the second game piece is activated when the player submits the second game piece to the game holding authority or its distributor. In some embodiments, the second game piece is activated when the barcode is read. In some embodiments, the second game piece is activated when the game holding authority approves the validity of the second game piece.

In some embodiments, in the next step, block 905, after the player's second game piece is activated, the game holding authority provides the player with a third game piece (e.g., a third ticket) carrying one or more third indicia of third game data of the game. In some embodiments, in the next step, block 906, the player analyzes the first, second, and third game data on corresponding tickets (e.g., comparing a combination of the first and second game data to the third game data). In some embodiments, in the next step, block 907, the game holding authority and/or the player determine if the played instance of the game (i.e., the combined game data of all three pieces) is a winner. In some embodiments, in the next step, block 908, the played instance of the game is the winner, the player redeems one or more played game pieces (e.g., the third game piece only, all three game pieces) to collect a prize. In some embodiments, in the next step, block 909, the prize is distributed to the player.

The computer and technical variations described with respect to the type 1 and 2 games are equally applicable to the illustrative example given in FIG. 9 of the type 3 of the games conducted in accordance with the instant invention. For example, one, two, or all played game pieces are electronically generated based at least in part on outcomes that can be randomly selected from a plurality of predetermined game outcomes, can be randomly generated, can be generated based at least in part on one or more predetermined rules, or can be produced by any combination of at least two of these methods. In another example, in some embodiments, the type 3 games can also be conducted, by its centralized server/host of the game holding authority, through a network of game distributors (e.g., human-assisted and/or unassisted lottery vending terminals).

Examples for Conducting Type 4 Games

Figure 10:
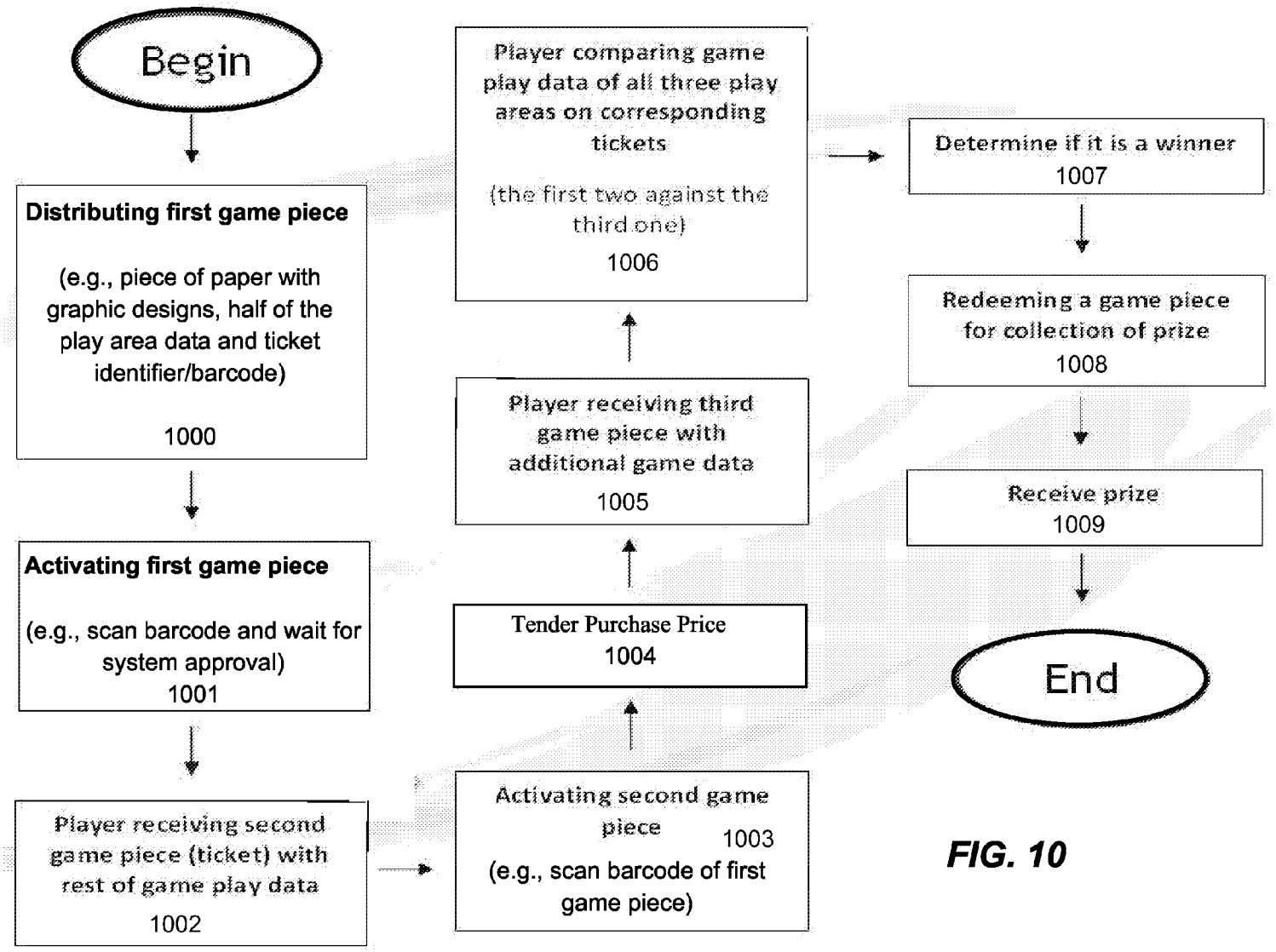
FIG. 10 shows yet another operational flow chart for performing some embodiments of the instant invention.

In some embodiments of the instant invention, the type 4 games can be conducted based on at least three game pieces. In some embodiments of the instant invention, the type 4 games are based on three game pieces where a player buys/pays for a chance (an instance) to play the game after a second game piece is provided to the player. Referring to FIG. 10. For example, in some embodiments, in the initial step, block 1000, the game can start when a player selects first game piece out of a displayed stock of pre-printed illustrative game pieces containing a part of first game data and a first identifier (e.g., barcode) which can be a unique identifier. In some embodiments of the instant invention, as the next step, the player reviews first game piece. In some embodiments of the instant invention, as the next step, the player presents first game piece to a lottery terminal of a game holding authority. In some embodiments of the instant invention, as the next step, block 1001, the lottery terminal reads first indicia of first game data which can include the first unique identifier of the first game piece (e.g., barcode, etc.). In some embodiments of the instant invention, as the next step, the lottery terminal transmits player's request (e.g., game data of the first game piece) to a central server/host of the game holding authority.

In some embodiments of the instant invention, as the next step, the host receives the player's request. In some embodiments of the instant invention, as the next step, the host logs the player's request. In some embodiments of the instant invention, as the next step, the host may conduct security check on the player's request (e.g., if ticket played before.) In some embodiments of the instant invention, as the next step, the host determines outcome (e.g., from predetermined pool of outcomes or on-the-spot draw.) In some embodiments of the instant invention, as the next step, the host generates one or more second indicia of second game data of game play data. In some embodiments of the instant invention, as the next step, the host transmits an approval to the lottery terminal.

In some embodiments of the instant invention, as the next step, block 1002, the lottery terminal dispenses to the player the second game piece containing the second game data. In some embodiments of the instant invention, as the next step, the player reviews first and second game pieces. In some embodiments of the instant invention, as the next step, the player presents first game piece again to the lottery terminal.

In some embodiments of the instant invention, as the next step, block 1003, the lottery terminal reads the first unique identifier again. In some embodiments of the instant invention, as the next step, block 10024, the player purchases a chance (an instance) to play the game. In some embodiments of the instant invention, as the next step, the lottery terminal accepts the payment. In some embodiments of the instant invention, as the next step, the lottery terminal transmits the first unique identifier to the host again. In some embodiments of the instant invention, as the next step, the host receives the player's first unique identifier again. In some embodiments of the instant invention, as the next step, the host checks if the second part of game data has been produced. In some embodiments of the instant invention, as the next step, the host determines outcome (e.g., from predetermined pool of outcomes or on-the-spot draw.) In some embodiments of the instant invention, as the next step, the host associates second unique identifier with the chance. In some embodiments of the instant invention, as the next step, the host generates one or more third indicia of third game data of the played game. In some embodiments of the instant invention, as the next step, the host transmits approval to the lottery terminal.

In some embodiments of the instant invention, as the next step, block 1005, the lottery terminal dispenses a third game piece. In some embodiments of the instant invention, as the next step, the lottery terminal records the approval of purchase. In some embodiments of the instant invention, as the next step, block 1006, the player tenders the third game piece to the lottery terminal after reviewing the first and second game pieces against the game data information on the third game piece. In some embodiments of the instant invention, as the next step, the lottery terminal receives the third game piece. In some embodiments of the instant invention, as the next step, the lottery terminal reads the second unique identifier. In some embodiments of the instant invention, as the next step, the lottery terminal transmits second unique identifier to the host.

In some embodiments of the instant invention, as the next step, the host receives the second unique identifier. In some embodiments of the instant invention, as the next step, the host may verify the second unique identifier. In some embodiments of the instant invention, as the next step, block 1007, the host of the game holding authority determines prize. In some embodiments of the instant invention, as the next step, the host updates prize table. In some embodiments of the instant invention, as the next step, the host of the game authority transmits an approval to the lottery terminal.

In some embodiments of the instant invention, as the next step, block 1008, the lottery terminal receives the approval to dispense a prize. In some embodiments of the instant invention, as the next step, block 1009, the lottery terminal dispenses the prize.

In some embodiments of the instant invention, the inventive game can be conducted by distributing a first game piece. In some embodiments of the instant invention, the next step is an activation of the first game piece. In some embodiments of the instant invention, the next step is that a player receives a second game piece (e.g., ticket) with the rest of the game play data. In some embodiments of the instant invention, the next step is an activation of the second game piece. In some embodiments of the instant invention, the next step is a tender of a purchase price. In some embodiments of the instant invention, the next step is that the player receives a third game piece with one or more third indicia of additional third game data. In some embodiments of the instant invention, the next step is that the player analyzes (e.g., compares) the game play data from all three game pieces (e.g., tickets) (e.g., first two against the third one). In some embodiments of the instant invention, the next step is to determine if the played instance of the game is a winner. In some embodiments of the instant invention, if the played game instance has won, the next step is to redeem the game piece(s) by distributing prize(s).

The computer and technical variations described with respect to the type 1 and 2 games are equally applicable to the illustrative example given in FIG. 10 of the type 4 of the games conducted in accordance with the instant invention. For example, one, two, or all played game pieces are electronically generated based at least in part on outcomes that can be randomly selected from a plurality of predetermined game outcomes, can be randomly generated, can be generated based at least in part on one or more predetermined rules, or can be produced by any combination of at least two of these methods. In another example, in some embodiments, the type 4 games can also be conducted, by its centralized server/host of the game holding authority, through a network of game distributors (e.g., human-assisted and/or unassisted lottery vending terminals).

Figure 11:
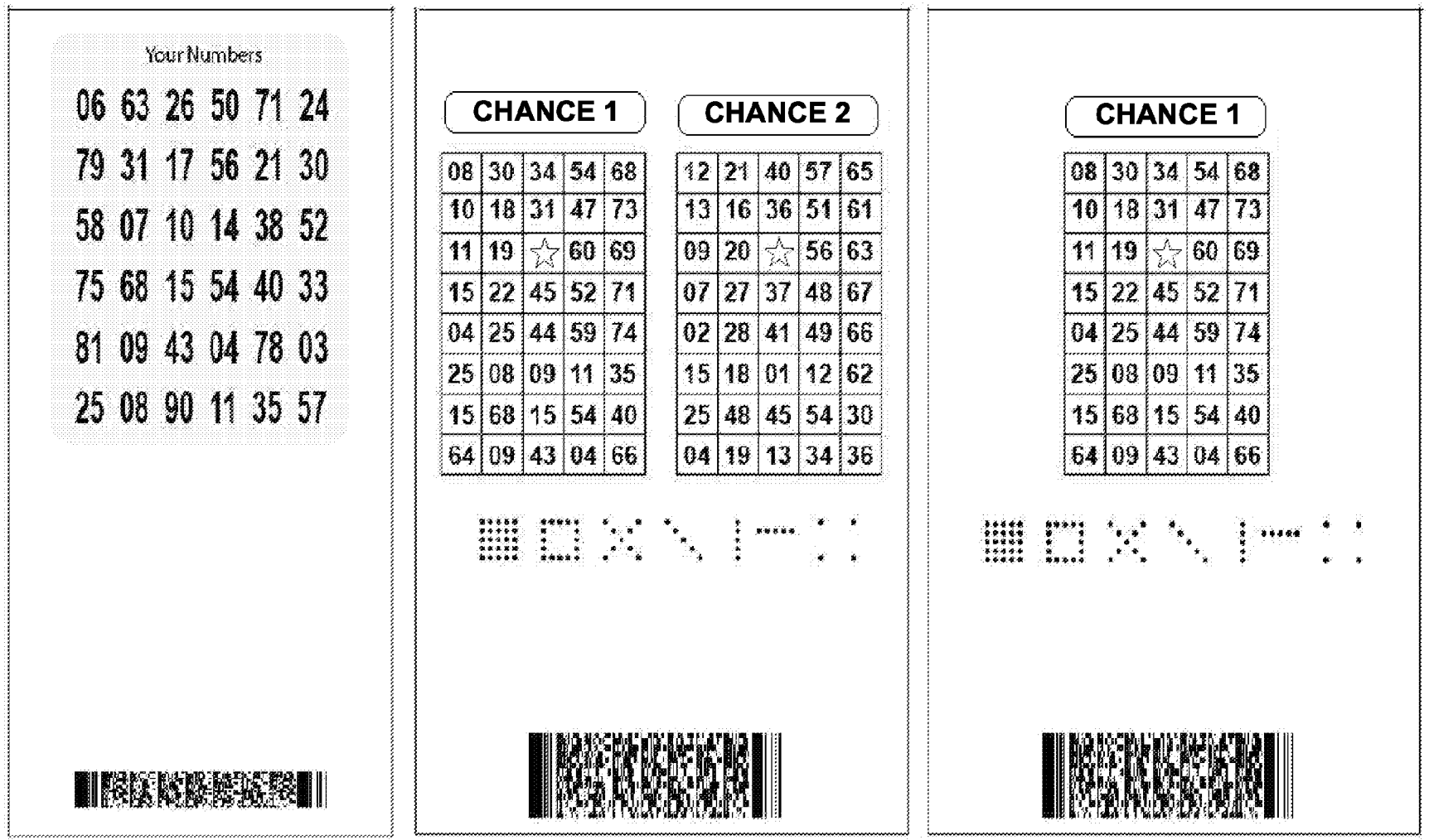
FIG. 11 illustrates some examples of game pieces for conducting games in accordance with some embodiments of the instant invention.

FIG. 11 illustrates another example of game pieces for conducting type 3 or 4 games.

In some embodiments of the instant invention, a game can be conducted based on at least four game pieces. In some embodiments of the instant invention, a game can be conducted based on at least five game pieces. In some embodiments of the instant invention, a game can be conducted based on at least six game pieces. In some embodiments of the instant invention, a game can be conducted based on at least seven game pieces. In some embodiments of the instant invention, a game can be conducted based on one or more multiples of the three or more game pieces.

Examples for Conducting Type 5 Games

In some embodiments of the instant invention, the type 5 games can be conducted as follows.

A game holding authority (1) determines characteristics and rules of a game, (2) determines game indicia for all game pieces for each instance of the played game by conducting drawings as detailed above regarding type 1-4 games of the type detailed above, and determines a prize distribution.

The game holding authority then electronically divides game pieces into virtual packs ("virtual pack" is a compilation of electronic data stored in at least one non-transient medium), containing game pieces for a certain number of instances of the game (e.g., game pieces for 25, 50, 100, etc., game instances) and electronically distributes those one or more virtual packs to its distributor(s). In some embodiments of the instant invention, the game holding authority electronically distributes one or more virtual packs to its distributor(s) at one time and/or distributes gradually, depending on sales level and request.

In some embodiments of the instant invention, every virtual pack remains inside the electronic computer device/system of a particular distributor and can be protected by a suitable security measure (e.g., password, a combination of a password and random generated number by an electronic device (e.g., electronic token) separately provided by the game holding authority to its distributor(s).

In some embodiments of the instant invention, a particular instance of the game begins when the distributor provides a first game piece to a player. In some embodiments, a particular instance of the game begins when the distributor provides more than one (e.g., first and second game pieces) to a player.

If the player wishes to continue, the distributor receives a payment from the player for player's participation.

Upon receipt of the payment, the distributor uses the provided security measure to access the played instance of the game and provides the remaining game piece(s) to the player. In some embodiments, the distributor first electronically communicates with the game holding authority to obtain authorization to access the virtual pack(s) stored at the distributor's computer system (e.g., password codes to open the virtual pack and access one or more game pieces within).

In some embodiments, the distributed remaining game piece(s) are uniquely associated by the game holding authority, prior to the distribution of the virtual pack(s) of game pieces to the distributor(s), with the game piece(s) that have been previously distributed to the player as the same instance of the game. In some embodiments, the distributed remaining game piece(s) are randomly selected from the stored virtual pack(s) of game pieces by the distributor's computer system to complete the particular instance of the game played by the player (e.g., particular second and third game pieces for the particular instance of the game played by the player are randomly selected from a pool of second and third game pieces in the virtual pack(s) stored by the distributor's computer system.)

The next step is to determine if the played instance of the game is a winner. If the played game instance has won, the next step is to redeem the game piece(s) by distributing prize(s). In some embodiments, the distributor distributes prize(s) upon a verification of the winning instance from the game holding authority. In some embodiments, the distributor distributes prize(s) without the verification of the winning instance with the game holding authority.

While a number of embodiments of the present invention have been described, it is understood that these embodiments are illustrative only, and not restrictive, and that many modifications may become apparent to those of ordinary skill in the art. Also, to the extent that such methods are implemented using a computer, not every step must necessarily be implemented using a computer. Further still, the various steps may be carried out in any desired order (and any desired steps may be added and/or any desired steps may be eliminated).

What is claimed is:

1. A computer-operated method to conduct a drawing game, comprising:

providing at least one first game piece, wherein the at least one first game piece has a first game data of the drawing game;

receiving, by a computer system, the first game data of the drawing game;

determining, by the computer system, a second game data of the drawing game based at least in part on:

i) the first game data, wherein the second data comprises the first game data, and ii) at least one predetermined rule;

randomly generating, by the computer system, a third game data of the drawing game;

providing, by the computer system, a second game piece having the second game data and the third game data of the drawing game to a player, wherein the second game piece is capable of enabling the player to determine, by comparing the second game data and the third game data of the drawing game, whether the player has won at least one prize of the drawing game.

2. The computer-operated method to conduct the drawing game of claim 1, wherein the providing, by the computer system, the first game piece comprises displaying on a computer screen, by the computer system, the first game piece.

3. The computer-operated method to conduct the drawing game of claim 1, wherein the providing, by the computer system, the first game piece comprises outputting, by the computer system, the first game piece in a paper format.

4. The computer-operated method to conduct the drawing game of claim 1, wherein the providing, by the computer system, the second game piece comprises displaying on a computer screen, by the computer system, the second game piece.

5. The computer-operated method to conduct the drawing game of claim 1, wherein the providing, by the computer system, the second game piece comprises outputting, by the computer system, the second game piece in a paper format.

6. The computer-operated method to conduct the drawing game of claim 1, wherein the at least one predetermined rule defines a distribution of the first game data within at least one visual pattern.

7. The computer-operated method to conduct the drawing game of claim 1, wherein the receiving, by the computer system, the first game data of the drawing game occurs after or with a payment for playing the drawing game is received from the player.

8. A computer-operated method to conduct a drawing game, comprising:

providing at least one first game piece, wherein the at least one first game piece has a first game data of the drawing game and at least one first code that uniquely identifies the at least one first game piece;

receiving, by a computer system, the at least one first code of the at least one first game piece of the drawing game;

activating, by the computer system, the at least one first game piece of the drawing game based at least in part on the at least one first code;

determining, by the computer system, a second game data of the drawing game, wherein the second game data of the drawing game is not based on the first game data of the drawing game; and providing, by the computer system, a second game piece having the second game data of the drawing game to a player, wherein the second game piece is capable of enabling the player to determine, by comparing the first game data and the second game data of the drawing game, whether the player has won at least one prize of the drawing game.

9. The computer-operated method to conduct the drawing game of claim 8, wherein the providing, by the computer system, the first game piece comprises displaying on a computer screen, by the computer system, the first game piece.

10. The computer-operated method to conduct the drawing game of claim 8, wherein the providing, by the computer system, the first game piece comprises outputting, by the computer system, the first game piece in a paper format.

11. The computer-operated method to conduct the drawing game of claim 8, wherein the providing, by the computer system, the second game piece comprises displaying on a computer screen, by the computer system, the second game piece.

12. The computer-operated method to conduct the drawing game of claim 8, wherein the providing, by the computer system, the second game piece comprises outputting, by the computer system, the second game piece in a paper format.

13. The computer-operated method to conduct the drawing game of claim 8, wherein the determining, by the computer system, the second game data of the drawing game comprises randomly generating the second game data.

14. The computer-operated method to conduct the drawing game of claim 8, wherein the determining, by the computer system, the second game data of the drawing game comprises determining the second game data based at least in part on at least one predetermined rule.

15. The computer-operated method to conduct the drawing game of claim 14, wherein the at least one predetermined rule defines a distribution of the second or the third game data within at least one visual pattern.

16. The computer-operated method to conduct the drawing game of claim 8, wherein the providing the at least one first game piece of the drawing game occurs after a payment for playing the drawing game is received from the player.

17. A computer-operated method to conduct a drawing game, comprising:

providing at least one first game piece, wherein the at least one first game piece has a first game data of the drawing game and at least one first code that uniquely identifies the at least one first game piece;

receiving, by a computer system, the first game data of the drawing game and the at least one first code of the at least one first game piece;

activating, by the computer system, the at least one first game piece of the drawing game based at least in part on the at least one first code;

determining, by the computer system, a second game data of the drawing game;

providing, by the computer system, a second game piece having the second game data of the drawing game to a player and at least one second code associated with the at least one second game piece;

receiving, by the computer system, the second game data of the drawing game and the at least one second code of the at least one second game piece;

activating, by the computer system, the at least one second game piece of the drawing game based at least in part on the at least one second code;

determining, by the computer system, a third game data of the drawing game;

providing, by the computer system, a third game piece having the third game data of the drawing game to a player;

wherein a combination of the at least one first game piece, the second game piece and the third game piece is capable of enabling the player to determine, by comparing the first game data, the second game data and the third game data of the drawing game, whether the player has won at least one prize of the drawing game.

18. The computer-operated method to conduct the drawing game of claim 17, wherein the providing the first game piece, the providing the second game piece, and the providing the third game piece comprise displaying on a computer screen the first game piece, the second game piece, and the third game piece, respectively.

19. The computer-operated method to conduct the drawing game of claim 17, wherein the providing the first game piece, the providing the second game piece, and the providing the third game piece comprise outputting, by the computer system, the first game piece, the second game piece, and the third game piece in a paper format, respectively.

20. The computer-operated method to conduct the drawing game of claim 17, wherein the determining the second game data and the determining the third game data comprise randomly generating the second game data and the third game data, respectively.

21. The computer-operated method to conduct the drawing game of claim 17, wherein the determining the second game data or the determining the third game data comprise randomly generating the second game data or the third game data, respectively.

22. The computer-operated method to conduct the drawing game of claim 17, wherein the determining the second game data and the determining the third game data comprise determining the second game data and determining the third game data based at least in part on at least one predetermined rule, respectively.

23. The computer-operated method to conduct the drawing game of claim 22, wherein the at least one predetermined rule defines a distribution of the second and the third game data within at least one visual pattern.

24. The computer-operated method to conduct the drawing game of claim 17, wherein the determining the second game data or the determining the third game data comprise determining the second game data or determining the third game data based at least in part on at least one predetermined rule, respectively.

25. The computer-operated method to conduct the drawing game of claim 24, wherein the at least one predetermined rule defines a distribution of the second or the third game data within at least one visual pattern.

26. The computer-operated method to conduct the drawing game of claim 17, wherein the providing the second game piece of the drawing game occurs after a payment for playing the drawing game is received from the player.

27. The computer-operated method to conduct the drawing game of claim 17, wherein the providing the third game piece of the drawing game occurs after a payment for playing the drawing game is received from the player.

* * * * *